US009080287B2

(12) United States Patent
Gustafson et al.

(10) Patent No.: US 9,080,287 B2
(45) **Date of Patent: *Jul. 14, 2015**

(54) INDUSTRIAL ROLL WITH MULTIPLE SENSOR ARRAYS

(71) Applicant: Stowe Woodward Licensco, LLC, Raleigh, NC (US)

(72) Inventors: Eric J. Gustafson, Winchester, VA (US); Samuel Howard Reaves, III, Stephens City, VA (US); Kisang Pak, Winchester, VA (US)

(73) Assignee: Stowe Woodward Licensco, LLC, Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/929,060

(22) Filed: Jun. 27, 2013

(65) Prior Publication Data

US 2013/0288868 A1 Oct. 31, 2013

Related U.S. Application Data

(63) Continuation of application No. 13/015,730, filed on Jan. 28, 2011, now Pat. No. 8,475,347.

(60) Provisional application No. 61/351,499, filed on Jun. 4, 2010.

(51) Int. Cl.
*B05C 1/08* (2006.01)
*G01L 5/00* (2006.01)
(Continued)

(52) U.S. Cl.
CPC .. *D21G 1/02* (2013.01); *D21F 3/06* (2013.01); *D21F 3/08* (2013.01); *Y10T 29/4956* (2015.01); *Y10T 29/49547* (2015.01)

(58) Field of Classification Search
USPC ..... 492/9, 10, 20, 26; 29/895, 895.2, 29/895.21, 895.211, 895.3, 895.32; 73/159, 862.55, 862.68; 702/138
See application file for complete search history.

(56) References Cited

U.S. PATENT DOCUMENTS 2,815,907 A 12/1957 McCormick
3,308,476 A 3/1967 Kleesattel
(Continued)

FOREIGN PATENT DOCUMENTS

DE 863133 1/1953
DE 199 20 133 11/2000
(Continued)

OTHER PUBLICATIONS

Anonymous "Les capteurs à fibres optiques opérationnels?" *Mesures Regulation Automatisme*, FR, CFW, Paris, Oct. 20, 1986, pp. 49-51, 53, 55, vol. 51, No. 13 (XP002083807).
(Continued)

*Primary Examiner* — Essama Omgba
(74) *Attorney, Agent, or Firm* — Myers Bigel Sibley & Sajovec, P.A.

(57) ABSTRACT

An industrial roll includes: a substantially cylindrical core having an outer surface; a polymeric cover circumferentially overlying the core outer surface; and a sensing system. The sensing system includes: a first signal carrying member serially connecting a first set of sensors; a second signal carrying member serially connecting a second set of sensors; and a signal processing unit operatively associated with the first and second signal carrying members and configured to selectively monitor the signals provided by the first and second set of sensors.

23 Claims, 6 Drawing Sheets

(51) Int. Cl.

| | |
|---|---|
| ***G01L 1/00*** | (2006.01) |
| ***D21G 1/02*** | (2006.01) |
| ***D21F 3/06*** | (2006.01) |
| ***D21F 3/08*** | (2006.01) |

(56) References Cited

U.S. PATENT DOCUMENTS

| | | | | |
|---|---|---|---|---|
| 3,562,883 | A | 2/1971 | Kobayashi | |
| 3,665,650 | A | 5/1972 | Przygocki | |
| 3,962,911 | A | 6/1976 | Grenlund | |
| 4,016,756 | A | 4/1977 | Kunkle | |
| 4,233,011 | A | 11/1980 | Bolender et al. | |
| 4,352,481 | A | 10/1982 | Forward | |
| 4,366,025 | A | 12/1982 | Gordon, Jr. et al. | |
| 4,445,349 | A | 5/1984 | Eibe | |
| 4,498,383 | A | 2/1985 | Pav et al. | |
| 4,509,237 | A | 4/1985 | Volz et al. | |
| 4,729,153 | A | 3/1988 | Pav et al. | |
| 4,871,908 | A | 10/1989 | Skuratovsky et al. | |
| 4,898,012 | A | 2/1990 | Jones et al. | |
| 4,903,517 | A | 2/1990 | Van Haag et al. | |
| 4,910,985 | A | 3/1990 | Ballyns | |
| 4,938,045 | A | 7/1990 | Rosenstock et al. | |
| 5,048,353 | A | 9/1991 | Justus | |
| 5,086,220 | A | 2/1992 | Berthold et al. | |
| 5,379,652 | A | 1/1995 | Allonen | |
| 5,383,371 | A | 1/1995 | Laitinen | |
| 5,466,343 | A | 11/1995 | Kankaanpaa | |
| 5,535,240 | A | 7/1996 | Carney et al. | |
| 5,562,027 | A | 10/1996 | Moore | |
| 5,592,875 | A | 1/1997 | Moschel | |
| 5,684,871 | A | 11/1997 | Devon et al. | |
| 5,684,912 | A | 11/1997 | Slaney et al. | |
| 5,699,729 | A | 12/1997 | Moschel | |
| 5,739,626 | A | 4/1998 | Kojima et al. | |
| 5,848,097 | A | 12/1998 | Carney et al. | |
| 5,874,723 | A | 2/1999 | Hasegawa et al. | |
| 5,915,648 | A | 6/1999 | Madrzak et al. | |
| 5,925,220 | A | 7/1999 | Hirsch et al. | |
| 5,947,401 | A | 9/1999 | Niccum | |
| 5,953,230 | A | 9/1999 | Moore | |
| 6,006,100 | A | 12/1999 | Koenck et al. | |
| 6,205,369 | B1 | 3/2001 | Moore | |
| 6,284,103 | B1 | 9/2001 | Eng et al. | |
| 6,328,681 | B1 | 12/2001 | Stephens | |
| 6,341,522 | B1 | 1/2002 | Goss et al. | |
| 6,354,013 | B1 | 3/2002 | Mucke et al. | |
| 6,361,483 | B1 | 3/2002 | Kirchner | |
| 6,375,602 | B1 | 4/2002 | Jones | |
| 6,430,459 | B1 | 8/2002 | Moore | |
| 6,441,904 | B1 | 8/2002 | Shakespeare | |
| 6,568,285 | B1 | 5/2003 | Moore et al. | |
| 6,617,764 | B2 | 9/2003 | Sebastian et al. | |
| 6,752,908 | B2 | 6/2004 | Gustafson et al. | |
| 6,874,232 | B2 | 4/2005 | Madden et al. | |
| 6,892,563 | B2 | 5/2005 | Gustafson et al. | |
| 6,910,376 | B2 | 6/2005 | Maenpaa | |
| 6,981,935 | B2 | 1/2006 | Gustafson | |
| 6,988,398 | B2 | 1/2006 | Saloniemi et al. | |
| 7,185,537 | B2 | 3/2007 | Muhs | |
| 7,225,688 | B2 | 6/2007 | Moore et al. | |
| 7,392,715 | B2 | 7/2008 | Moore et al. | |
| 7,572,214 | B2 | 8/2009 | Gustafson | |
| 7,581,456 | B2 | 9/2009 | Moore et al. | |
| 7,963,180 | B2 | 6/2011 | Moore et al. | |
| 8,236,141 | B2 * | 8/2012 | Pak | 162/363 |
| 8,236,414 | B2 | 8/2012 | Piluso et al. | |
| 8,346,501 | B2 | 1/2013 | Pak | |
| 8,474,333 | B2 * | 7/2013 | Berendes et al. | 73/862.55 |
| 8,475,347 | B2 * | 7/2013 | Gustafson et al. | 492/10 |
| 2003/0115947 | A1 | 6/2003 | Soloniemi et al. | |
| 2004/0053758 | A1 | 3/2004 | Gustafson | |
| 2005/0000303 | A1 | 1/2005 | Moore et al. | |
| 2005/0261115 | A1 | 11/2005 | Moore | |
| 2006/0090574 | A1 | 5/2006 | Moore et al. | |
| 2006/0248723 | A1 | 11/2006 | Gustafson | |
| 2008/0264184 | A1 | 10/2008 | Moore et al. | |
| 2009/0320612 | A1 | 12/2009 | Moore et al. | |
| 2010/0324856 | A1 | 12/2010 | Pak | |
| 2011/0226070 | A1 | 9/2011 | Berendes et al. | |
| 2012/0310596 | A1 | 12/2012 | Gustafson et al. | |
| 2014/0374460 | A1 * | 12/2014 | Breineder et al. | 226/45 |

FOREIGN PATENT DOCUMENTS

| | | | |
|---|---|---|---|
| EP | 538221 | | 4/1993 |
| EP | 1 493 565 | A2 | 1/2005 |
| EP | 1 653 207 | A2 | 5/2006 |
| EP | 1 719 836 | A1 | 11/2006 |
| FR | 2 769 379 | | 4/1999 |
| JP | 2006164244 | A | 6/2006 |
| JP | 2009298265 | | 12/2009 |
| WO | WO 96/34262 | A1 | 10/1996 |
| WO | WO 01/53787 | A1 | 7/2001 |
| WO | WO 2005/113891 | A1 | 12/2005 |
| WO | WO 2010/043433 | | 4/2010 |

OTHER PUBLICATIONS

Bazergui, A., and M.L. Meyer, "Embedded Strain Gages for the Measurement of Strains in Rolling Contact," *Experimental Mechanics*, Oct. 1968, pp. 433-441.

Examiner's report for Canadian Application No. 2741931 mailed Jul. 11, 2012.

Keller, S.F., "Measurement of the Pressure-Time Profile in a Rolling Calender Nip," *77th Annual Meeting of the Canadian Section of the Pulp and Paper Assn.* 1991, pp. B89-B96.

Knowles, S.F., et al., "Multiple Microbending Optical-fibre Sensors for Measurement of Fuel Quantity in Aircraft Fuel Tanks," *Sensors and Actuators*, Jun. 15, 1998, pp. 320-323, vol. 68. No. 1-3 (XP004139852).

Koriseva, J., et al., "Soft Calendar Nip: An interesting Subject for Research and Measurement," *Paper and Timber*, 1991, pp. 419-423, vol. 73, No. 5.

McCollum, T., and G. B. Spector, "Fiber Optic Microbend Sensor for Detection of Dynamic Fluid Pressure at Gear Interfaces," *Rev. Sci. Instrum.*, Mar. 1, 1994, pp. 724-729. vol. 65, No. 3 (XP000435198).

McNamee, J.P., "A Study of Rubber Covered Press Roll Nip Dynamics, Part 1," *The Journal of the Technical Association of the Pulp and Paper Industry*, Dec. 1965. pp. 673-679, vol. 48, No. 12.

Merriman, T.L., "Transducers and Techniques of Contact Pressure Measurement," Paper presented at *The Society for Experimental Mechanics, Spring Conference*, Jun. 1991, pp. 318-320.

Parish, G.J., "Measurements of Pressure Distribution Between Metal and Rubber Covered Rollers," *British Journal of Applied Physics*, Apr. 1959, pp. 158-161, vol. 9.

Preliminary Report of Issuance of Office Action for Japanese Patent Application No. 2011-125400, mailed on Dec. 21, 2012.

Spengos, A.C., "Experimental Investigation of Rolling Contact" *Journal of Applied Mechanics*, Dec. 1965, pp. 859-864.

International Search Report for PCT/US01/02013, mailed May 22, 2001.

International Search Report for PCT/US03/18895 mailed Sep. 30, 2003.

International Search Report for PCT/US2005/016456 mailed Sep. 5, 2005.

International Search Report and Written Opinion for PCT/US2010/038581 mailed Dec. 23, 2010.

European Search Report for EP 05 02 7237, dated Aug. 29, 2006.

The Extended European Search Report for European Patent Application No. 10166806.9-2314; dated Oct. 13, 2010.

* cited by examiner

INDUSTRIAL ROLL WITH MULTIPLE SENSOR ARRAYS

RELATED APPLICATIONS

This application claims is a continuation of U.S. application Ser. No. 13/015,730, filed Jan. 28, 2011, now U.S. Pat. No. 8,475,347, issued Jul. 2, 2013, and claims the benefit of priority from U.S. Provisional Patent Application No. 61/351,499, filed Jun. 4, 2010, the disclosure of which is hereby incorporated herein in its entirety.

FIELD OF THE INVENTION

This invention relates to industrial rolls, and more particularly to rolls for papermaking.

BACKGROUND

In a typical papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more presses (often roller presses) covered with another fabric, typically referred to as a "press felt." Pressure from the presses removes additional moisture from the web; the moisture removal is often enhanced by the presence of a "batt" layer of the press felt. The paper is then transferred to a dryer section for further moisture removal. After drying, the paper is ready for secondary processing and packaging.

Cylindrical rolls are typically utilized in different sections of a papermaking machine, such as the press section. Such rolls reside and operate in demanding environments in which they can be exposed to high dynamic loads and temperatures and aggressive or corrosive chemical agents. As an example, in a typical paper mill, rolls are used not only for transporting the fibrous web sheet between processing stations, but also, in the case of press section and calender rolls, for processing the web sheet itself into paper.

Typically rolls used in papermaking are constructed with the location within the papermaking machine in mind, as rolls residing in different positions within the papermaking machines are required to perform different functions. Because papermaking rolls can have many different performance demands, and because replacing an entire metallic roll can be quite expensive, many papermaking rolls include a polymeric cover that surrounds the circumferential surface of a typically metallic core. By varying the material employed in the cover, the cover designer can provide the roll with different performance characteristics as the papermaking application demands. Also, repairing, regrinding or replacing a cover over a metallic roll can be considerably less expensive than the replacement of an entire metallic roll. Exemplary polymeric materials for covers include natural rubber, synthetic rubbers such as neoprene, styrene-butadiene (SBR), nitrile rubber, chlorosulfonated polyethylene ("CSPE"—also known under the trade name HYPALON from DuPont), EDPM (the name given to an ethylene-propylene terpolymer formed of ethylene-propylene diene monomer), polyurethane, thermoset composites, and thermoplastic composites.

In many instances, the roll cover will include at least two distinct layers: a base layer that overlies the core and provides a bond thereto; and a topstock layer that overlies and bonds to the base layer and serves the outer surface of the roll (some rolls will also include an intermediate "tie-in" layer sandwiched by the base and top stock layers). The layers for these materials are typically selected to provide the cover with a prescribed set of physical properties for operation. These can include the requisite strength, elastic modulus, and resistance to elevated temperature, water and harsh chemicals to withstand the papermaking environment. In addition, covers are typically designed to have a predetermined surface hardness that is appropriate for the process they are to perform, and they typically require that the paper sheet "release" from the cover without damage to the paper sheet. Also, in order to be economical, the cover should be abrasion- and wear-resistant.

As the paper web is conveyed through a papermaking machine, it can be very important to understand the pressure profile experienced by the paper web. Variations in pressure can impact the amount of water drained from the web, which can affect the ultimate sheet moisture content, thickness, and other properties. The magnitude of pressure applied with a roll can, therefore, impact the quality of paper produced with the paper machine.

Other properties of a roll can also be important. For example, the stress and strain experienced by the roll cover in the cross machine direction can provide information about the durability and dimensional stability of the cover. In addition, the temperature profile of the roll can assist in identifying potential problem areas of the cover.

It is known to include pressure and/or temperature sensors in the cover of an industrial roll. For example, U.S. Pat. No. 5,699,729 to Moschel et al. describes a roll with a helically-disposed leads that includes a plurality of pressure sensors embedded in the polymeric cover of the roll. The sensors are helically disposed in order to provide pressure readings at different axial locations along the length of the roll. Typically the sensors are connected by a signal carrying member that transmits sensor signals to a processor that processes the signals and provides pressure and position information.

More particularly, as each sensor passes through a nip, the sensor becomes loaded and emits a signal. The sensor then becomes unloaded after it passes through the nip. However, the sensors are serially connected by the signal carrying member, and sensor signals can overlap or superimpose if more than one sensor is passing through a nip at the same time. Accordingly, the system may not produce an accurate pressure profile in certain applications.

The sensor signals can overlap in extended or wide nip applications. For example, an industrial roll can be positioned relative to a mating structure, such as a shoe of a shoe press, to form a relatively wide nip therewith. In this instance, at least adjacent sensors can be located in the nip at the same time, and this can result in erroneous measurements.

Signals can also overlap or be superimposed in applications in which a roll is positioned so as to mate with multiple mating structures, thereby creating multiple nips. Exemplary applications include grouped rolls in a press section and rolls in a calendering section. In these instances, at least one sensor can be in each nip at a particular time. Again, this can result in erroneous measurements.

SUMMARY

As a first aspect, embodiments of the present invention are directed to an industrial roll. The industrial roll includes: a substantially cylindrical core having an outer surface; a polymeric cover circumferentially overlying the core outer surface; and a sensing system. The sensing system includes: a plurality of sensors comprising a first set of sensors and a second set of sensors at least partially embedded in the polymeric cover and arranged in a helical configuration around the roll, wherein the sensors are configured to sense an operating parameter experienced by the roll and provide signals related to the operating parameter, and wherein the sensors of the first sensor set are distinct from the sensors of the second sensor set; a first signal carrying member serially connecting the first set of sensors; a second signal carrying member serially connecting the second set of sensors; and a signal processing unit operatively associated with the first and second signal carrying members, wherein the signal processing unit is configured to selectively monitor the signals provided by the first and second set of sensors.

As a second aspect, embodiments of the present invention are directed to an industrial roll. The industrial roll includes: a substantially cylindrical core having an outer surface; a polymeric cover circumferentially overlying the core outer surface; and a sensing system. The sensing system includes: a first signal carrying member serially connecting a first set of sensors at least partially embedded in the polymeric cover and arranged in a first helical configuration defined by a first helix angle around the roll, wherein the sensors are configured to sense an operating parameter experienced by the roll and provide signals related to the operating parameter, and wherein the first helix angle is defined by an angle between a circumferential position of a first endmost sensor in the first set of sensors and a circumferential position of a second endmost sensor in the first set of sensors relative to the axis of rotation of the roll; a second signal carrying member spaced apart from the first signal carrying member, the second signal carrying member serially connecting a second set of sensors at least partially embedded in the polymeric cover and arranged in a second helical configuration defined by a second helix angle around the roll, wherein the sensors are configured to sense an operating parameter experienced by the roll and provide signals related to the operating parameter, and wherein the second helix angle is defined by an angle between a circumferential position of a first endmost sensor in the second set of sensors and a circumferential position of a second endmost sensor in the second set of sensors relative to the axis of rotation of the roll; and a signal processing unit operatively associated with the first and second signal carrying members, wherein the signal processing unit is configured to selectively monitor the signals provided by the first and second set of sensors.

As a third aspect, embodiments of the present invention are directed to a method of measuring an operating parameter experienced by an industrial roll. The method includes providing an industrial roll, including: a substantially cylindrical core having an outer surface; a polymeric cover circumferentially overlying the core outer surface; and a sensing system. The sensing system includes: a plurality of sensors comprising a first set of sensors and a second set of sensors at least partially embedded in the polymeric cover and arranged in a helical configuration around the roll, wherein the sensors are configured to sense an operating parameter experienced by the roll and provide signals related to the operating parameter; a first signal carrying member serially connecting a first set of sensors; a second signal carrying member serially connecting a second set of sensors; and a signal processing unit operatively associated with the first and second signal carrying members, wherein the signal processing unit is configured to selectively monitor the signals provided by the first and second set of sensors. The method further includes rotating the roll with a mating structure positioned relative to the industrial roll to form a nip therewith such that no more than one sensor of the first sensor set and no more than one sensor of the second sensor set is positioned in the nip simultaneously.

As a fourth aspect, embodiments of the present invention are directed to a method of measuring an operating parameter experienced by an industrial roll. The method includes providing an industrial roll, including: a substantially cylindrical core having an outer surface; a polymeric cover circumferentially overlying the core outer surface; and a sensing system. The sensing system includes: a first signal carrying member serially connecting a first set of sensors embedded in the polymeric cover and arranged in a first helical configuration defined by a first helix angle around the roll, wherein the sensors are configured to sense an operating parameter experienced by the roll and provide signals related to the operating parameter, and wherein the first helix angle is defined by an angle between a circumferential position of a first endmost sensor in the first set of sensors and a circumferential position of a second endmost sensor in the first set of sensors relative to the axis of rotation of the roll; a second signal carrying member spaced apart from the first signal carrying member, the second signal carrying member serially connecting a second set of sensors embedded in the polymeric cover and arranged in a second helical configuration defined by a second helix angle around the roll, wherein the sensors are configured to sense an operating parameter experienced by the roll and provide signals related to the operating parameter, and wherein the second helix angle is defined by an angle between a circumferential position of a first endmost sensor in the second set of sensors and a circumferential position of a second endmost sensor in the second set of sensors relative to the axis of rotation of the roll; and a signal processing unit operatively associated with the first and second signal carrying members, wherein the signal processing unit is configured to selectively monitor the signals provided by the first and second set of sensors. The method further includes rotating the roll with a first mating structure positioned relative to the roll to form a first nip therewith and with a second mating structure positioned relative to the roll to form a second nip therewith such that no more than one sensor of the first sensor set is positioned in the first nip and the second nip simultaneously and no more than one sensor of the second sensor set is positioned in the first nip and the second nip simultaneously.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
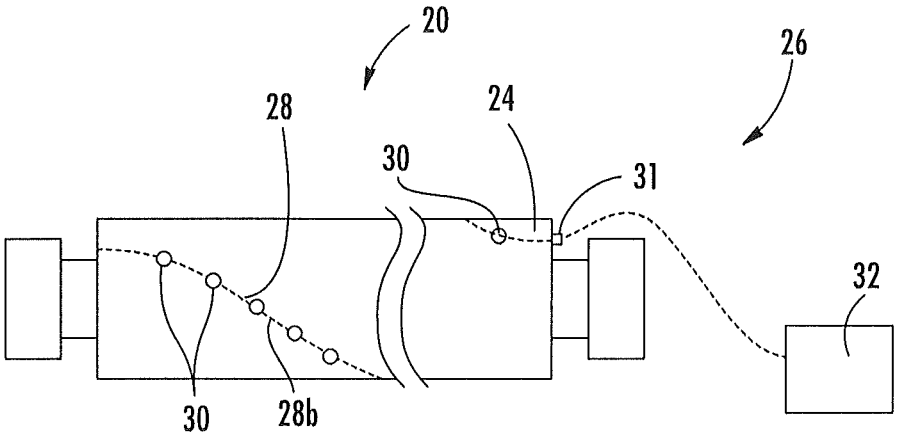
FIG. 1 (PRIOR ART)
FIG. 1 is a gage view of a prior art roll and associated detecting system.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. As used herein, the term "and/or" includes any and all combinations of one or more of the associated listed items. Where used, the terms "attached," "connected," "interconnected," "contacting," "coupled," "mounted," "overlying" and the like can mean either direct or indirect attachment or contact between elements, unless stated otherwise.

Figure 2:
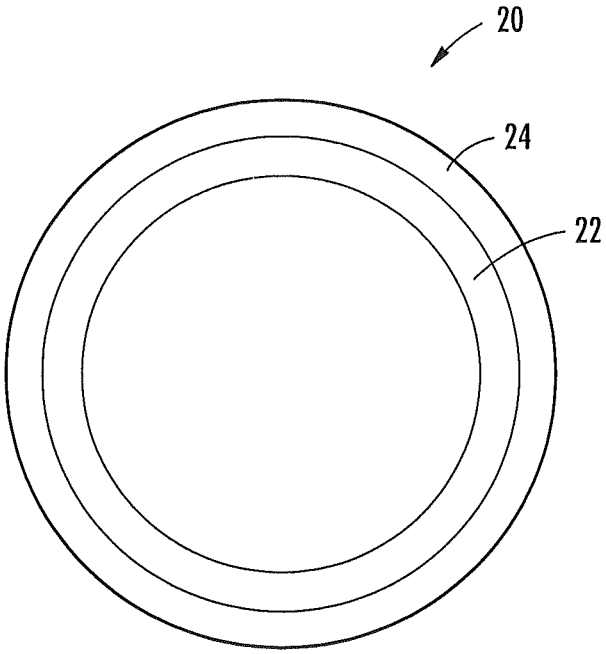
FIG. 2 (PRIOR ART)
FIG. 2 is a cross-sectional view of the roll of FIG. 1.

Referring now to the figures, a conventional roll, designated broadly at 20, is illustrated in FIG. 1. The roll 20 includes a cylindrical core 22 (FIG. 2) and a cover 24 (typically formed of one or more polymeric materials) that encircles the core 22. A sensing system 26 for sensing an operating parameter (e.g., pressure, temperature, nip width, etc.) includes a signal carrying member 28 and a plurality of sensors 30, each of which is at least partially embedded in the cover 24. As used herein, a sensor being "embedded" in the cover means that the sensor is entirely contained within the cover, and a sensor being "embedded" in a particular layer or set of layers of the cover means that the sensor is entirely contained within that layer or set of layers. The sensing system 26 also includes a processor 32 that processes signals produced by the sensors 30.

The core 22 is typically formed of a metallic material, such as steel or cast iron. The core 22 can be solid or hollow, and if hollow may include devices that can vary pressure or roll profile.

The cover 24 can take any form and can be formed of any polymeric and/or elastomeric material recognized by those skilled in this art to be suitable for use with a roll. Exemplary materials include natural rubber, synthetic rubbers such as neoprene, styrene-butadiene (SBR), nitrile rubber, chlorosulfonated polyethylene ("CSPE"—also known under the trade name HYPALON), EDPM (the name given to an ethylene-propylene terpolymer formed of ethylene-propylene diene monomer), epoxy, and polyurethane. The cover 24 may also include reinforcing and filler materials, additives, and the like. Exemplary additional materials are discussed in U.S. Pat. No. 6,328,681 to Stephens, U.S. Pat. No. 6,375,602 to Jones, and U.S. Pat. No. 6,981,935 to Gustafson, the disclosures of each of which are incorporated herein in their entireties.

The roll 20 can be manufactured in the manner described, for example, in U.S. Patent Application Publication No. 2005/0261115 to Moore et al. and co-pending U.S. patent application Ser. No. 12/489,711 to Pak, the disclosures of each of which are incorporated herein in their entireties. As described in these applications, the cover 24 may comprise multiple layers. For example, the core 22 may be covered with an inner base layer, and the signal carrying member 28 and sensors 30 may then be positioned and adhered in place. An outer base layer may then be applied and a topstock layer may be applied over the outer base layer. The present invention is intended to include rolls having covers 24 that include only a base layer and top stock layer as well as rolls having covers with additional intermediate layers. Any intermediate layers may be applied over the outer base layer prior to the application of the topstock layer. In some embodiments, the sensors 30 may be at least partially embedded in a layer. In some other embodiments, the sensors 30 may be between two layers such that the sensors 30 are on top of one layer and covered by a second, different layer.

The completed roll 20 and cover 24 can then be used in, for example, a papermaking machine. In some embodiments, the roll 20 is part of a nip press, wherein one or more rolls or pressing devices are positioned adjacent the roll 20 to form one or more nips through which a forming paper web can pass. In such environments, it can be important to monitor the pressure experienced by the cover 24, particularly in the nip area(s). The sensing system 26 can provide pressure information for different axial locations along the cover 24, with each of the sensors 30 providing pressure information about a different axial location on the roll 20. In some other embodiments, the roll 20 is part of a calendering section to provide a finish to the paper product. It is noted that, in calendering applications, the roll cover may be polymeric, cotton, or chilled iron, with the sensors at least partially embedded in the cover.

Still referring to FIG. 1, the sensors 30 of the sensing system 26 are suitable for detecting an operating parameter of the roll 20, such as pressure. The sensors 30 can take any shape or form recognized by those skilled in this art, including piezoelectric sensors, optical sensors, and the like. Exemplary sensors are discussed in U.S. Pat. No. 5,562,027 to Moore; U.S. Pat. No. 5,699,729 to Moschel et al.; U.S. Pat. No. 6,429,421 to Meller; U.S. Pat. No. 6,981,935 to Gustafson; and U.S. Pat. No. 7,572,214 to Gustafson, U.S. Patent Application Publication No. 2005/0261115 to Moore et al., and co-pending U.S. patent application Ser. No. 12/488, 753 to Pak and Ser. No. 12/489,711 to Pak, the disclosures of each of which are incorporated herein in their entireties.

The signal carrying member 28 of the sensing system 26 can be any signal-carrying member recognized by those skilled in this art as being suitable for the passage of electrical signals in a roll. In some embodiments, the signal carrying member 28 may comprise a pair of leads, each one contacting a different portion of each sensor 30, as described, for example, in the aforementioned U.S. patent application Ser. No. 12/489,711 to Pak.

The sensing system 26 includes a multiplexer 31 or other data collection device mounted to the end of the roll 20. The multiplexer 31 receives and collects signals from the sensors 30 and transmits them to a processer 32. The processor 32 is typically a personal computer or similar data exchange device, such as the distributive control system of a paper mill, that is operatively associated with the sensors 30 and that can process signals from the sensors 30 into useful, easily understood information. In some embodiments, a wireless communication mode, such as RF signaling, is used to transmit the data collected from the sensors 30 from the multiplexer 31 to the processor 32. Other alternative configurations include slip ring connectors that enable the signals to be transmitted from the sensors 30 to the processor 32. Suitable exemplary processing units are discussed in U.S. Pat. Nos. 5,562,027 and 7,392,715 to Moore, U.S. Pat. No. 5,699,729 to Moschel et al., and U.S. Pat. No. 6,752,908 to Gustafson et al., the disclosures of each of which are hereby incorporated herein in their entireties.

In operation, the roll 20 and cover 24 rotate about the axis of the roll 20 at very high speeds. Each time one of the sensors 30 passes through a nip created by the roll 20 and a mating roll or press, the sensor 30 will transmit a pulse generated by the pressure the mating roll exerts on the area of the roll 20 above the sensor 30. When no sensor 30 is present in the nip, no significant pulses beyond the level of general noise are generated. Thus, as the roll 20 rotates, each sensor 30 travels through the nip and provides pulses representative of the pressure at its corresponding location. Consequently, data in the form of pulses is generated by the sensors 30, transmitted along the signal carrying member 28, and received in the multiplexer 31. In a typical data retrieval session, 10-30 pulses are received per sensor 30; these individual pulses can be stored and processed into representative pressure signals for each sensor 30. Once the raw sensor data is collected, it is sent from the multiplexer 31 to the processor 32 for processing into an easily understood form, such as a pressure profile of the roll 20 along its length.

Figure 3:
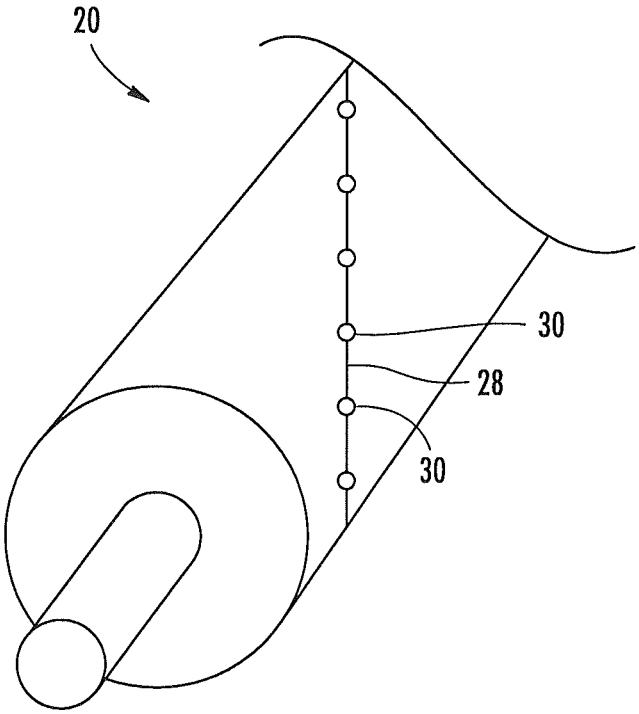
FIG. 3 (PRIOR ART)
FIG. 3 is an end perspective view of a portion of the roll of FIG. 1 and sensors thereon serially connected by a signal carrying member.

FIG. 3 illustrates a portion of the roll 20 including the sensors 30 serially connected by the signal carrying member 28. The sensors 30 are typically evenly spaced axially (although in some applications, such as rolls used in the production of tissue, the sensors may be more concentrated near the ends of the roll). Typically, one helix curves fully around the roll 20 such that each sensor 30 is positioned at a unique axial and circumferential position, thereby allowing an operating parameter to be measured at each position. Helical sensor configurations are described in more detail in the aforementioned U.S. Pat. No. 5,699,729 to Moschel et al. and the aforementioned U.S. Patent Application Publication No. 2005/0261115 to Moore et al.

Figure 4:
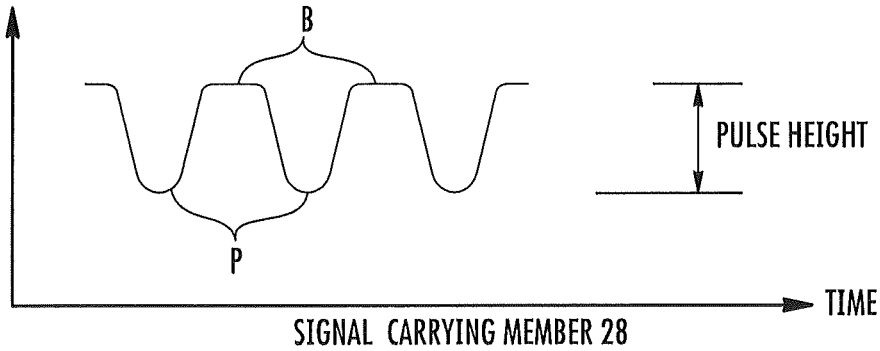
FIG. 4 (PRIOR ART)
FIG. 4 is a graph illustrating an exemplary signal transmitted by the signal carrying member of FIG. 3.

FIG. 4 is a graph illustrating an exemplary signal transmitted from the signal carrying member 28. As each sensor 30 enters a nip, it becomes loaded and emits a pulse represented by one of the inverted peaks P in the signal. Each sensor 30 becomes unloaded as it leaves the nip. A baseline B is established between the inverted peaks P. Nip pressure is determined by pulse height or amplitude, which is the difference between the inverted peaks P and the baseline B.

Figure 5:
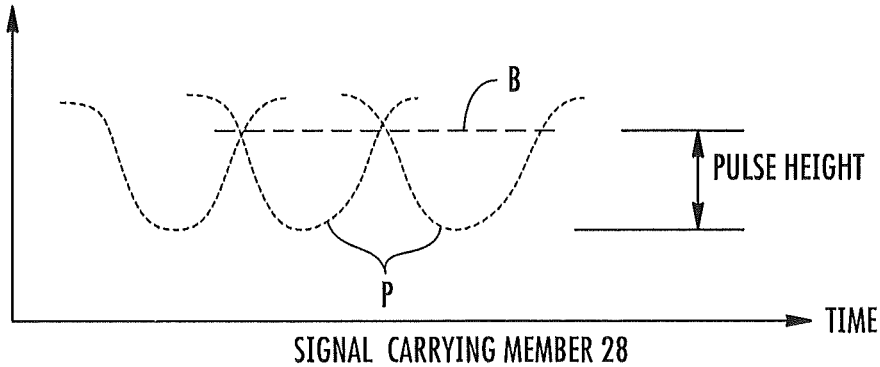
FIG. 5 (PRIOR ART)
FIG. 5 is a graph illustrating an alternative exemplary signal transmitted by the signal carrying member of FIG. 3.

Ideally, and as illustrated in FIG. 4, all sensors 30 will be unloaded such that a consistent baseline B is established between the peaks P. However, this will not be the case when the roll 20 is used in certain applications in which more than one sensor 30 is partially or fully loaded at the same time. Because the signal carrying member 28 serially connects the sensors 30, there is only one signal which is the sum of the output from all the sensors 30. FIG. 5 is a graph illustrating another exemplary signal transmitted by the signal carrying member 28 in which the pulses P overlap. In this example, adjacent sensors 30 are partially loaded at the same time. This alters the baseline B (i.e., shifts the baseline downward) and therefore reduces the pulse height, resulting in erroneous measurements.

This problem may occur in extended or wide nip applications. The sensor system of the roll 20 illustrated in FIGS. 1 and 3 may be appropriate for nips approximately 1 inch wide, such as some nips formed between two rolls in a press section. However, extended or wide nips, such as those formed when the roll mates with a shoe of a shoe press, can be up to 10 inches wide, and can sometimes be even wider. As a result, in these applications, pulses from at least two adjacent sensors 30 can overlap. The angular or circumferential spacing between adjacent sensors 30 could be increased; however, this would result in a reduced total number of sensors 30 and a profile with large void spaces between measurement locations (sensor positions).

Figure 6:
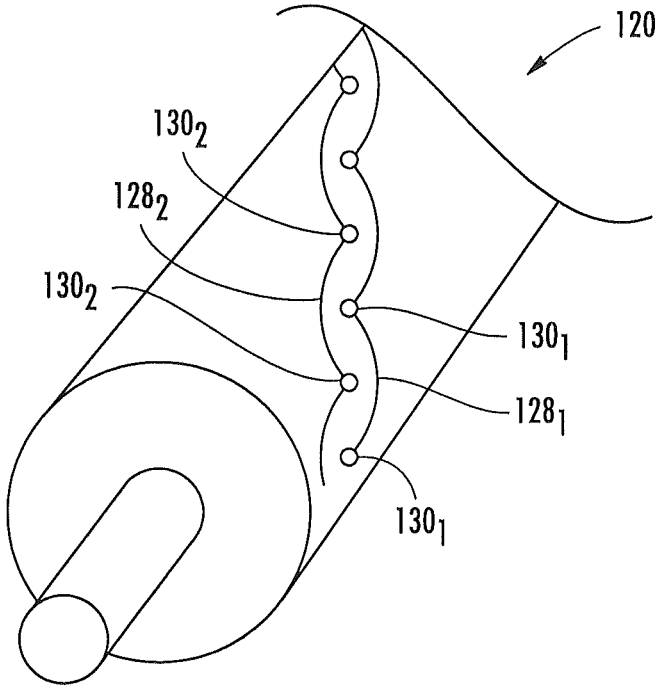
FIG. 6 is an end perspective view of a portion of a roll and sensors thereon connected by a plurality of signal carrying members according to some embodiments of the invention.

FIG. 6 illustrates an embodiment that can overcome the problems encountered in wide nip applications. A roll 120 includes a sensing system including a first set of sensors $\mathbf{130}_1$ and a second set of sensors $\mathbf{130}_2$. The sensors $\mathbf{130}_1$ of the first set are distinct from the sensors $\mathbf{130}_2$ of the second set. The sensors $\mathbf{130}_1$, $\mathbf{130}_2$ are arranged in helical configurations around the roll 120. Each sensor $\mathbf{130}_1$, $\mathbf{130}_2$ is configured to sense an operating parameter (e.g., pressure) experienced by the roll 120 and provide signals related to the operating parameter.

The sensing system also includes first and second signal carrying members $\mathbf{128}_1$, $\mathbf{128}_2$. The first signal carrying member $\mathbf{128}_1$ serially connects the first set of sensors $\mathbf{130}_1$ and the second signal carrying member $\mathbf{128}_2$ serially connects the second set of sensors $\mathbf{130}_2$. In the illustrated embodiment, the axial distance between adjacent sensors $\mathbf{130}_1$ of the first set is increased (e.g., doubled) as compared to the axial distance between adjacent sensors 30 of the roll 20 illustrated in FIGS. 1 and 3. Likewise, the axial distance between adjacent sensors $\mathbf{130}_2$ of the second set is increased (e.g., doubled) as compared to axial distance between adjacent sensors 30 of the roll 20. This configuration can increase the time between the signal peaks from adjacent sensors of an individual signal carrying member $\mathbf{128}_1$, $\mathbf{128}_2$. These increased durations can eliminate the overlapping signals that can be encountered from sensors serially connected by a single signal carrying member.

The sensing system also includes a signal processing unit or device that is operatively associated with the first signal carrying member $\mathbf{128}_1$ (and therefore the first set of sensors $\mathbf{130}_1$) and the second signal carrying member $\mathbf{128}_2$ (and therefore the second set of sensors $\mathbf{130}_2$). The signal processing unit or device is configured to selectively monitor (or receive data from) the signals provided by the first and second set of sensors $\mathbf{130}_1$, $\mathbf{130}_2$. In some embodiments, the signal processing unit or device is configured to alternately monitor (or receive data from) the first signal carrying member $\mathbf{128}_1$ and the second signal carrying member $128_2$. The signal processing unit or device is described in more detail below.

In some embodiments, and as illustrated in FIG. 6, the sensors $130_1$ of the first set and the sensors $130_2$ of the second set alternate within the helical configuration. The first signal carrying member $128_1$ can bypass the sensors $130_2$ of the second set and the second signal carrying member $128_2$ can bypass the sensors $130_1$ of the first set. As used herein, a signal carrying member "bypassing" one or more sensors means that the signal carrying member does not contact the one or more sensors. The signal carrying member may bypass a sensor by passing above, below, and/or around the sensor. The signal carrying member may be at least partially embedded at a different depth in the cover of the roll as the particular sensor being bypassed (e.g., in the case of a signal carrying member passing above or below the sensor) or may be at least partially embedded at the same or substantially the same depth in the cover of the roll as the particular sensor being bypassed (e.g., in the case of a signal carrying member passing around the sensor). As illustrated, the first signal carrying member $128_1$ may "curve" around the sensors $130_2$ of the second set and the second signal carrying member $128_2$ may "curve" around the sensors $130_1$ of the first set.

Figure 13:
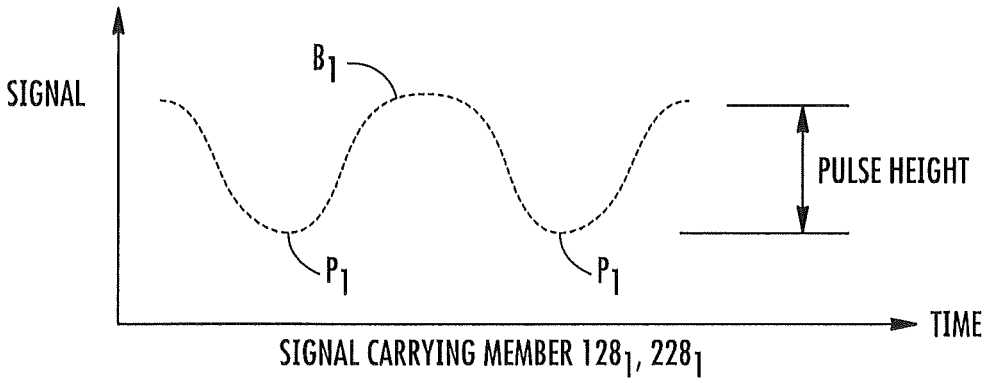
FIGS. 13 and 14 are graphs illustrating exemplary signals transmitted by the signal carrying members of FIGS. 6 and 8.
Figure 14:
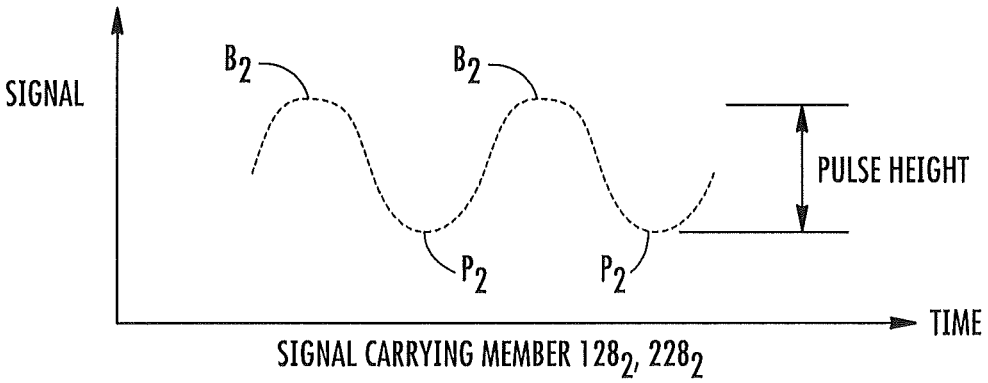

FIGS. 13 and 14 are graphs illustrating exemplary signals transmitted from signal carrying members $128_1$ and $128_2$, respectively. As described above, and as shown in FIG. 13, the time between pulses P1 from adjacent sensors $130_1$ increases due to the increased axial spacing of sensors $130_1$. This helps to ensure that the pulses P1 do not overlap, and likewise helps to ensure that a proper baseline B1 is established. Similarly, as shown in FIG. 14, the time between pulses P2 from adjacent sensors $130_2$ increases due to the increased axial spacing of sensors $130_2$, and this helps to ensure that the pulses P2 do not overlap and helps to ensure that a proper baseline B2 is established. After monitoring the signal from the first set of sensors $130_1$ (e.g., after the pulse P1 but before the pulse P3), the processor 132 can switch and monitor the signal from the second set of sensors $130_2$ (e.g., the pulse P2 illustrated in FIG. 10). The processor 132 may switch between monitoring the first and second set of sensors $130_1$, $130_2$ in various ways. In some embodiments, the processor 132 is configured to alternately monitor the signals from the first set of sensors $130_1$ and the second set of sensors $130_2$.

Therefore, by employing multiple sets of sensors that can be selectively monitored, erroneous measurements due to pulse overlapping can be minimized or prevented and sensor coverage on the roll is not compromised, thereby allowing for an accurate and comprehensive roll profile.

Figure 7:
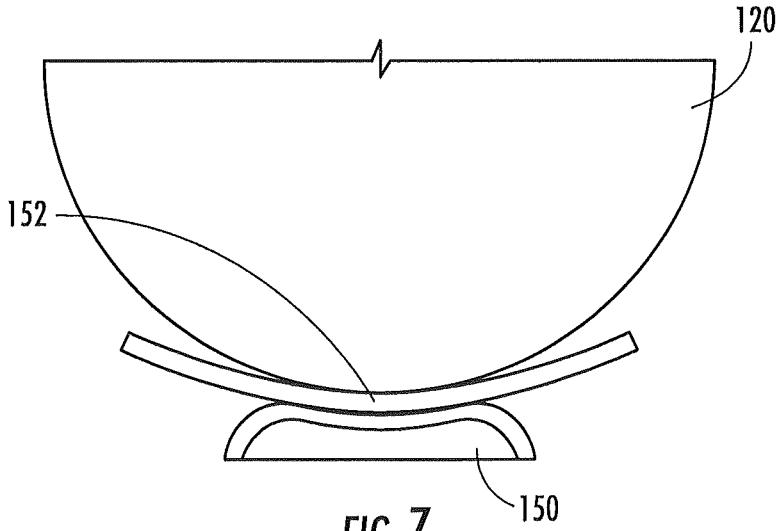
FIG. 7 is an end view of the roll of FIG. 6 positioned relative to a mating structure to form a nip therewith.

As described above, the roll 120 can be particularly useful when positioned relative to a mating structure to form a relatively wide nip therewith. To illustrate, FIG. 7 shows mating structure 150 (for example, a shoe of a shoe press) positioned relative to the roll 120 to form a relatively wide nip 152 therewith. The sensing system described above can be configured such that no more than one sensor $130_1$ of the first sensor set and no more than one sensor $130_2$ of the second sensor set is positioned in the nip 152 simultaneously.

Although two sets of sensors and two signal carrying members have been described in detail above and illustrated in FIG. 6, it is envisioned that more than two sensor sets could be employed as needed, with each sensor set connected by an individual signal carrying member. More than two sensor sets may be needed, for example, in applications involving particularly wide nips.

Figure 9:
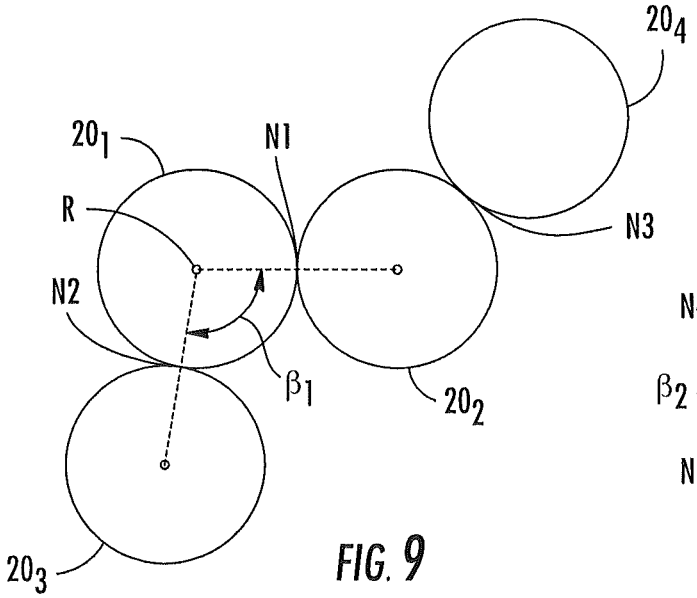
FIGS. 9 and 10 are end views of configurations in which the roll of FIG. 8 may be positioned relative to multiple mating structures to form multiple nips therewith.
Figure 10:
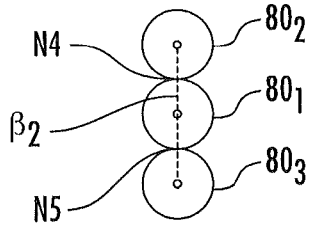

Rolls and sensing systems such as the one illustrated in FIGS. 1 and 3 can also be incompatible with multiple nip configurations. Examples of such configurations are grouped rolls in a press section (FIG. 9) and calender sections (FIG. 10). In FIG. 9, press rolls $20_2$, $20_3$ are positioned relative to press roll $20_1$ to form nips N1, N2 therewith. Similarly, in FIG. 10, calender rolls $80_2$, $80_3$ are positioned relative to calender roll $80_1$ to form nips N4, N5 therewith. If the roll 20 (as illustrated in FIGS. 1 and 3) were used in place of roll $20_1$ (or roll $80_1$), at least one sensor 30 may be at least partially loaded in each nip N1, N2 (or each nip N4, N5) at a particular time during operation. This can result in at least two signals overlapping or being superimposed because the sensors 30 are all serially connected by the signal carrying member 28. In the case of overlapping signals, the baseline may be altered as described in more detail above. Moreover, superimposed signals can lead to confusion as to which signal corresponds to which nip.

To overcome the problem of at least one sensor being loaded in more than one nip simultaneously, the angular or circumferential spacing of the sensors 30 shown in FIGS. 1 and 3 could be reduced. This would in turn reduce the helix angle defined by sensors 30 such that the helix formed by the sensors 30 would not wrap completely around the roll 20. However, to maintain the same number of sensors, the axial spacing between adjacent sensors would need to be reduced. This may lead to the same problems described above with regard to extended or wide nip applications, i.e., more than one sensor could be positioned in a single nip at the same time and signals may overlap.

Figure 8:
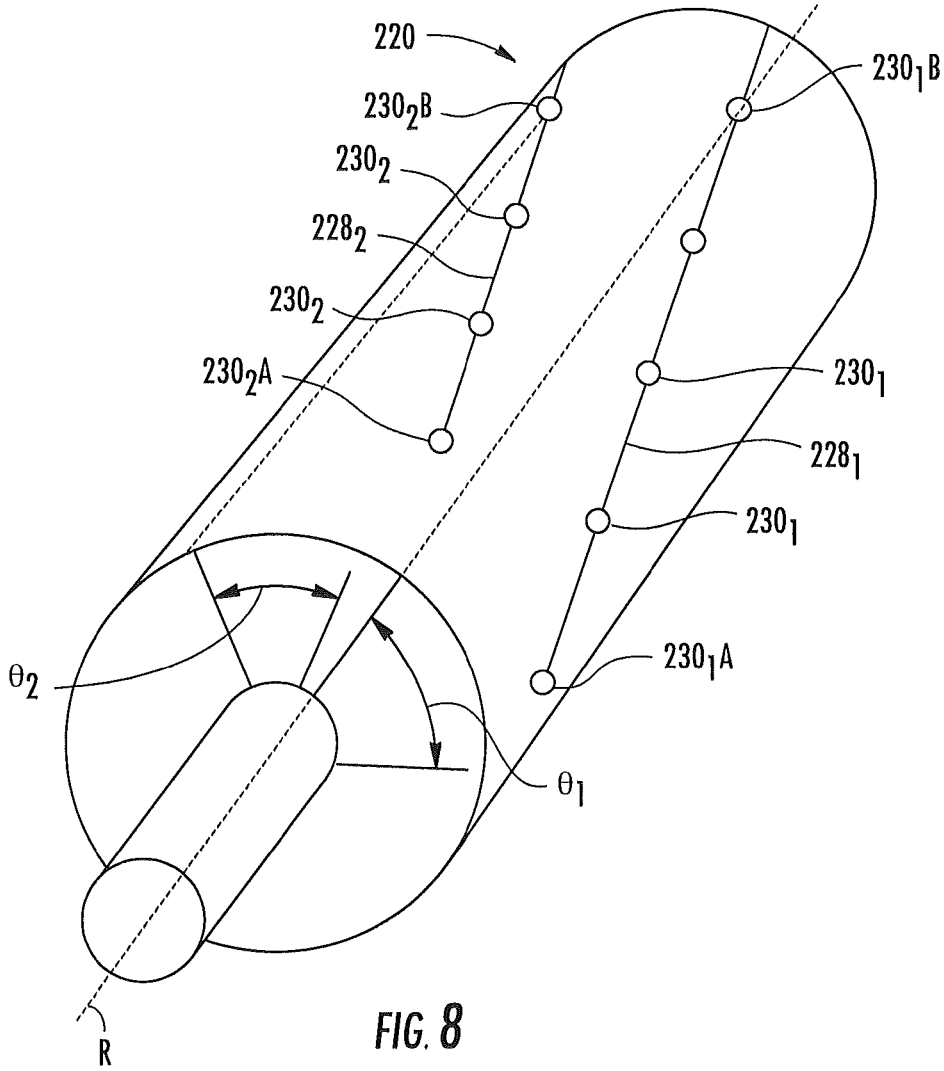
FIG. 8 is an end perspective view of a roll and sensors thereon connected by a plurality of signal carrying members according to some embodiments of the invention.

FIG. 8 illustrates an embodiment that can overcome these problems associated with multiple nip configurations. A roll 220 includes sensing system including a first signal carrying member $228_1$ serially connecting a first set of sensors $230_1$. The sensors $230_1$ are configured to sense an operating parameter (e.g., pressure) experienced by the roll 220 and provide signals related to the operating parameter. The first signal carrying member $228_1$ is arranged in a first helical configuration defined by a first helix angle θ1 around the roll 220. The first helix angle θ1 is defined by an angle between an angular or circumferential position of a first endmost sensor $230_1$A and an angular or circumferential position of a second endmost sensor $230_1$B relative to the axis of rotation R of the roll 220.

The sensing system of the roll 220 also includes a second signal carrying member $228_2$ spaced apart from the first signal carrying member $228_1$. The second signal carrying member $228_2$ serially connects a second set of sensors $230_2$. The sensors $230_2$ are configured to sense an operating parameter (e.g., pressure) experienced by the roll 220 and provide signals related to the operating parameter. The first signal carrying member $228_2$ is arranged in a second helical configuration defined by a second helix angle θ2 around the roll 220. The second helix angle θ2 is defined by an angle between an angular or circumferential position of a first endmost sensor $230_2$A and an angular or circumferential position of a second endmost sensor $230_2$B relative to the axis of rotation R of the roll 220.

The sensing system of the roll 220 also includes a signal processing unit or device operatively associated with the first and second signal carrying members $228_1$, $228_2$. The signal processing unit or device is configured to selectively monitor the signals transmitted by the first signal carrying member $228_1$ (and therefore provided by the first set of sensors $230_1$) and the signals transmitted by the second signal carrying member $228_2$ (and therefore provided by the second set of sensors $230_2$). In some embodiments, the signal processing unit or device is configured to alternately monitor the signals transmitted by the first signal carrying member $228_1$ and the signals transmitted by the second signal carrying member $228_2$. The signal processing unit or device is described in more detail below.

In the illustrated embodiment, the angular spacing between adjacent sensors $230_1$ of the first sensor set is reduced and the angular spacing between adjacent sensors $230_2$ of the second sensor set is reduced. This configuration may prevent more than one sensor associated with a particular signal carrying member $228_1$, $228_2$ from being positioned in more than one nip simultaneously. Furthermore, the axial spacing between adjacent sensors $230_1$ of the first sensor set is increased and the axial spacing between adjacent sensors $230_2$ of the second sensor set is increased. This may prevent more than one sensor associated with a particular signal carrying member $228_1$, $228_2$ from being positioned in more the same nip simultaneously.

It is noted that only nine sensors (five sensors $230_1$ of the first sensor set and four sensors $230_2$ of the second sensor set) have been illustrated in FIG. 9 to provide clarity. It is envisioned that fewer or more sensors could be used. For example, there may be 11 sensors $230_1$ and 10 sensors $230_2$. There may also be an equal number of sensors $230_1$, $230_2$. Furthermore, it is envisioned that the helix angles θ1, θ2 may be less than or greater than as illustrated. For example, one or both of the helix angles θ1, θ2 may be greater than illustrated such that the respective signal carrying members $228_1$, $228_2$ "curve around" the roll 220 more than as illustrated.

Moreover, although two sets of sensors and two signal carrying members are described in detail herein and illustrated in FIG. 8, it is envisioned that more than two sensor sets could be employed as needed, with each sensor set connected by an individual signal carrying member.

The sensors $230_1$ and the sensors $230_2$ can be axially staggered relative to one another to prevent any "voids" in a roll profile and therefore allow for a comprehensive profile. For example, the sensors $230_2$ of the second set can have an axial position midway or approximately midway between the sensors $230_1$ of the first set.

In some embodiments, the first and second helix angles θ1, θ2 may be substantially equal. Thus, the signal carrying members $228_1$, $228_2$ may be substantially parallel. The spacing between the signal carrying members $228_1$, $228_2$ may vary depending on the helix angles θ1, θ2 employed. In some embodiments, the helix angles θ1, θ2 do not overlap; therefore, the sensors $230_1$ of the first sensor set span a first circumferential portion of the roll 220 and the sensors $230_2$ of the second sensor set span a second, different circumferential portion of the roll 220.

As described above, the roll 220 may be particularly useful when positioned relative to more than one mating structure to form more than one nip therewith. In some embodiments, a first mating structure is positioned relative to the industrial roll 220 to form a first nip therewith and a second mating structure is positioned relative to the industrial roll 220 to form a second nip therewith. The sensing system can be configured such that no more than one sensor $230_1$ of the first sensor set is positioned in the first nip and the second nip simultaneously and no more than one sensor $230_2$ of the second sensor set is positioned in the first nip and the second nip simultaneously.

By way of example, and referring to FIG. 9, press rolls $20_2$ and $20_3$ can be positioned relative to press roll $20_1$ to form respective nips N1, N2 therewith. Roll $20_1$ may assume the configuration of roll 220 illustrated in FIG. 8 such that no more than one sensor $230_1$ is positioned in the nip N1 and the nip N2 at the same time and no more than one sensor $230_2$ is positioned in the nip N1 and the nip N2 at the same time. By way of further example, and referring to FIG. 10, calender rolls $80_2$ and $80_3$ can be positioned relative to calender roll $80_1$ to form respective nips N4, N5 therewith. Roll $80_1$ may assume the configuration of roll 220 illustrated in FIG. 8 such that no more than one sensor $230_1$ is positioned in the nip N4 and the nip N5 at the same time and no more than one sensor $230_2$ is positioned in the nip N4 and the nip N5 at the same time.

In some embodiments, the first and second helix angles θ1, θ2 are less than or equal to an angle defined by the first and second nips. Referring to FIG. 9, for example, the nip N1 and the N2 define an angle β1 therebetween. The angle β1 is measured relative to the axis of rotation R of roll $20_1$, which is normal to the page. The first and second helix angles θ1, θ2 may be less than or equal to the angle β1 to help ensure that no more than one sensor $230_1$ of the first sensor set is positioned in the nips N1 and N2 simultaneously and no more than one sensor $230_2$ of the second sensor set is positioned in the nips N1 and N2 simultaneously.

Still referring to FIG. 9, it is noted that groups of press rolls may include one or more additional rolls, such as roll $20_4$. In this regard, press rolls $20_1$ and $20_4$ may be positioned relative to press roll $20_2$ to form respective nips N1, N3 therewith. Roll $20_2$ may then assume the configuration of roll 220 illustrated in FIG. 8 such that no more than one sensor $230_1$ is positioned in the nip N1 and the nip N3 at the same time and no more than one sensor $230_2$ is positioned in the nip N1 and the nip N3 at the same time.

The use of more than one sensor array may also be advantageous in that monitoring may continue even if one (or more) of the arrays stops functioning. For example, if one of the signal carrying members $128_1$, $128_2$ illustrated in FIG. 6 breaks, the sensors connected by the other of the signal carrying members $128_1$, $128_2$ may still provide signals. The same may apply for the signal carrying members $228_1$, $228_2$ illustrated in FIG. 8.

Figure 11:
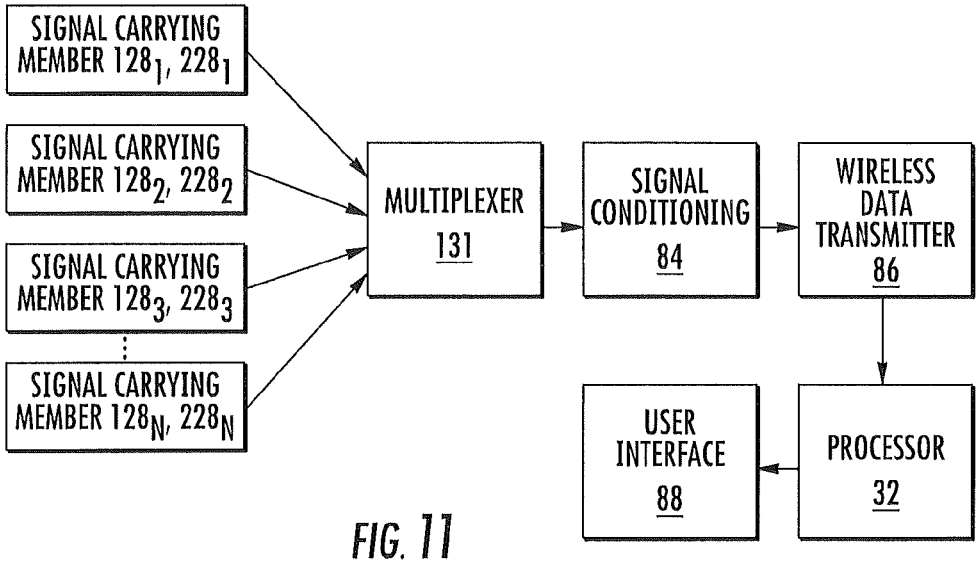
FIG. 11 is a block diagram illustrating components for the transmission of data from the signal carrying members of FIGS. 6 and 8.
Figure 12:
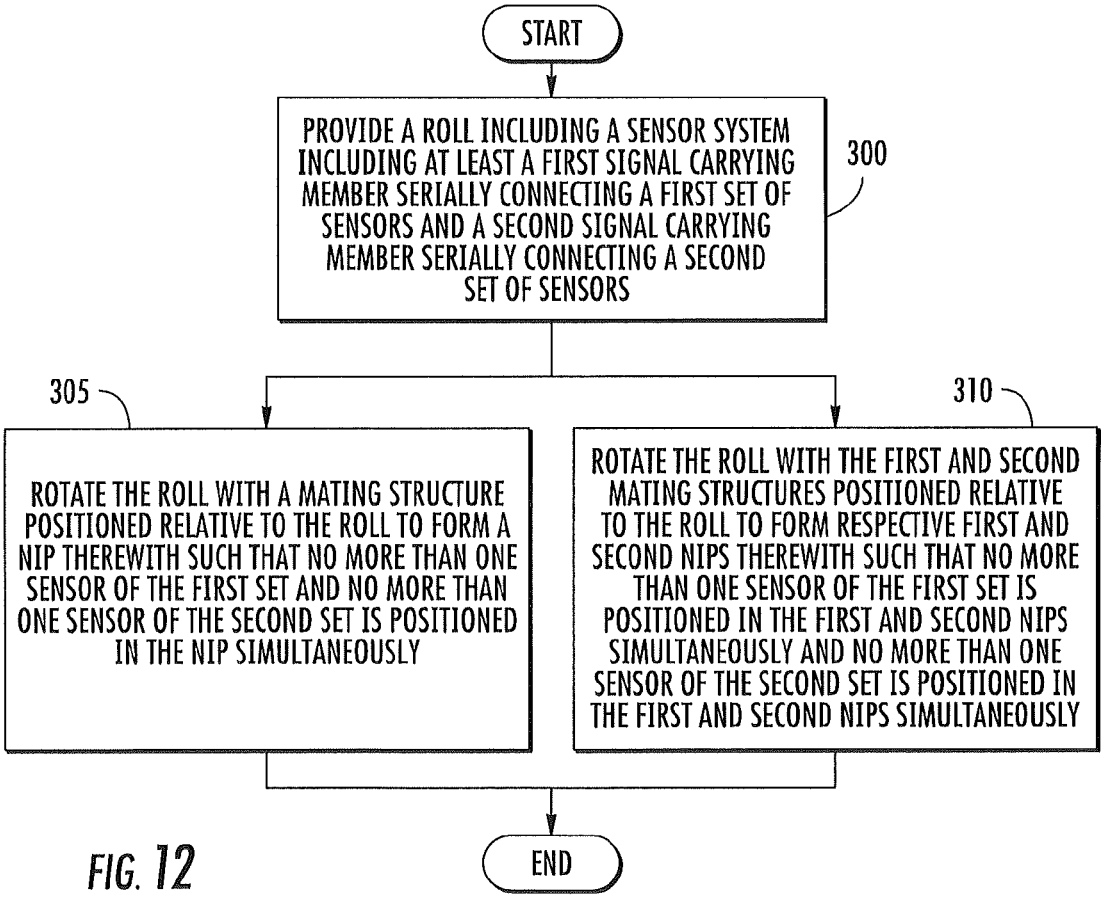
FIG. 12 is a flowchart illustrating operations according to some embodiments of the invention.

Turning now to FIG. 11, system components for use with the rolls 120, 220 are illustrated. In particular, FIG. 11 illustrates how data may flow from the sensors (or the signal carrying members) to a user. As described above, the rolls 120, 220 can include a plurality of signal carrying members (e.g., $128_1$, $128_2$, $128_3$, . . . $128_N$). The signal carrying members may be electrically coupled to one or more multiplexers 131. The one or more multiplexers 131 may be electrically coupled to a signal conditioning unit 84. The signal conditioning unit 84 may transmit conditioned signals representing the measured operating parameter (e.g., pressure) to the processor 32. The link between the signal conditioning unit 84 and the processor 32 may be a wireless data transmitter 86. Alternatively, the signal conditioning unit 84 and the processor 32 may be hardwired. The processor 32 may transmit data to a user interface unit 88. For example, the user interface unit 88 may include a display, a printer, and the like. The user interface unit 88 may be configured to present data in a user-friendly manner (e.g., a roll pressure profile may be displayed to the user). The processor 32 may be hardwired to the user interface unit 88 or data may be transmitted wirelessly.

It is noted that, although not shown, there may be an amplifier and/or an analog-to-digital converter after the multiplexer (s) 131 and before data is stored to memory. Data may be stored to memory because data may be created faster than it can be wirelessly transmitted.

For example, where used, the signal conditioning unit 84 may include a microprocessor buffer in which data is stored before it is transmitted to the processor 32. In some embodiments, the buffer is partitioned such that a certain amount of space is reserved for each signal carrying member. For example, if there are two signal carrying members $128_1$, $128_2$, the buffer may be partitioned such that one-half or about one-half of the buffer is reserved for data transmitted from the first signal carrying member $128_1$ and one-half or about one-half of the buffer is reserved for data transmitted from the second signal carrying member $128_2$. A user may send a command to collect data at the user interface unit 88. The multiplexer 131 (or a first multiplexer 131) may be set to receive signals transmitted from the first signal carrying member $128_1$ and one-half or about one-half the buffer may be filled with data from the first signal carrying member $128_1$. The multiplexer 31 may then switch (or a second multiplexer 131 may be set) to receive signals transmitted from the second signal carrying member $128_2$ and the remainder of the buffer may be filled with data from the second signal carrying member $128_2$. At this point, all the data may be transmitted to the processor 132. The data may then be sent to the user interface 88 in an appropriate format.

In some other embodiments, the buffer can be filled with data from one signal carrying member at a time. For example, if there are two signal carrying members $128_1$, $128_2$, upon command from a user, the data processor 32 may first request data from the first signal carrying member $128_1$. The multiplexer 131 (or a first multiplexer 131) may be set to receive signals transmitted from the first signal carrying member $128_1$ and the buffer may be filled with data from the first signal carrying member $128_1$. The data from the first signal carrying member $128_1$ may then transmitted to the processor 32. Before providing the data to the user interface 88, the multiplexer 131 may then switch (or a second multiplexer 131 may be set) to receive signals transmitted from the second signal carrying member $128_2$ and the buffer may be filled with data from the second signal carrying member $128_2$. The data from the from the second signal carrying member $128_2$ may then transmitted to the data processor 32, at which point the processor 32 may combine the two sets of data to create a pressure profile at the user interface 88, for example.

As described above, the sensing systems of the rolls 120, 220 include a signal processing unit or device operatively associated with the signal carrying members and configured to selectively monitor the signals transmitted from the signal carrying members (or provided by the sensors associated therewith). In various embodiments, the signal processing unit or device may include one or more of the components illustrated in FIG. 11, such as the multiplexer(s) 131, the signal conditioning unit 84, the wireless data transmitter 86, the processor 32, and/or the user interface device 88.

Methods of measuring an operating parameter experienced by an industrial roll according to some embodiments of the invention are illustrated in FIG. 15. A roll is provided including at least a first signal carrying member serially connecting a first set of sensors and a second signal carrying member serially connecting a second set of sensors (Block 300). The roll may take the form of either of rolls 120, 220 described above. In particular, the roll can include any of the features described above in reference to rolls 120, 220.

In some embodiments, the roll is rotated with a mating structure positioned relative to the roll to form a nip therewith such that no more than one sensor of the first sensor set and no more than one sensor of the second sensor set is positioned in the nip simultaneously (Block 305). In some other embodiments, the roll is rotated with a first mating structure positioned relative to the roll to form a first nip therewith and with a second mating structure positioned relative to the roll to form a second nip therewith such that no more than one sensor of the first sensor set is positioned in the first nip and the second nip simultaneously and no more than one sensor of the second sensor set is positioned in the first nip and the second nip simultaneously (Block 310).

In some embodiments, the signals from the first sensor set and the signals from the second sensor set can be alternately monitored and/or transmitted. The data from the first set of sensors and the second set of sensors can be transmitted to create an operating parameter (e.g., pressure) profile.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An industrial roll, comprising:

a substantially cylindrical core having an outer surface;

a polymeric cover circumferentially overlying the core outer surface; and a sensing system comprising:

a first signal carrying member serially connecting a first set of sensors at least partially embedded in the polymeric cover and arranged in a first helical configuration defined by a first helix angle around the roll, wherein the sensors are configured to sense an operating parameter experienced by the roll and provide signals related to the operating parameter, and wherein the first helix angle is defined by an angle between a circumferential position of a first endmost sensor in the first set of sensors and a circumferential position of a second endmost sensor in the first set of sensors relative to the axis of rotation of the roll;

a second signal carrying member spaced apart from the first signal carrying member, the second signal carrying member serially connecting a second set of sensors at least partially embedded in the polymeric cover and arranged in a second helical configuration defined by a second helix angle around the roll, wherein the sensors are configured to sense an operating parameter experienced by the roll and provide signals related to the operating parameter, and wherein the second helix angle is defined by an angle between a circumferential position of a first endmost sensor in the second set of sensors and a circumferential position of a second endmost sensor in the second set of sensors relative to the axis of rotation of the roll; and a signal processing unit operatively associated with the first and second signal carrying members, wherein the signal processing unit is configured to selectively monitor the signals provided by the first and second set of sensors;

wherein the first signal carrying member bypasses the sensors of the second sensor set, and wherein the second signal carrying member bypasses the sensors of the first sensor set;

the industrial roll in combination with a first mating structure positioned relative to the industrial roll to form a first nip therewith and a second mating structure positioned relative to the industrial roll to form a second nip therewith, wherein the sensing system is configured such that no more than one sensor of the first sensor set is positioned in the first nip and the second nip simultaneously and no more than one sensor of the second sensor set is positioned in the first nip and the second nip simultaneously.

2. The industrial roll of claim 1, wherein the sensors of the first set of sensors and the sensors of the second set of sensors are axially spaced apart from each other.

3. The industrial roll of claim 1, wherein the first and second helix angles are substantially equal.

4. The industrial roll in combination with the first and second mating structures as defined in claim 1, wherein the first and second nips define an angle therebetween relative to the axis of rotation of the roll, and wherein the first and second helix angles are less than or equal to the angle defined by the first and second nips.

5. The industrial roll of claim 1, wherein the signal processing unit is configured to alternately monitor the signals from the first set of sensors and the signals from the second set of sensors.

6. The industrial roll of claim 1, wherein the operating parameter is pressure.

7. The industrial roll of claim 1, wherein the first and second helix angles are each less than 180 degrees.

8. An industrial roll, comprising:

a substantially cylindrical core having an outer surface;

a polymeric cover circumferentially overlying the core outer surface; and a sensing system comprising:

a first signal carrying member serially connecting a first set of sensors at least partially embedded in the polymeric cover and arranged in a first helical configuration defined by a first helix angle around the roll, wherein the sensors are configured to sense an operating parameter experienced by the roll and provide signals related to the operating parameter, and wherein the first helix angle is defined by an angle between a circumferential position of a first endmost sensor in the first set of sensors and a circumferential position of a second endmost sensor in the first set of sensors relative to the axis of rotation of the roll;

a second signal carrying member spaced apart from the first signal carrying member, the second signal carrying member serially connecting a second set of sensors at least partially embedded in the polymeric cover and arranged in a second helical configuration defined by a second helix angle around the roll, wherein the sensors are configured to sense an operating parameter experienced by the roll and provide signals related to the operating parameter, and wherein the second helix angle is defined by an angle between a circumferential position of a first endmost sensor in the second set of sensors and a circumferential position of a second endmost sensor in the second set of sensors relative to the axis of rotation of the roll; and a signal processing unit operatively associated with the first and second signal carrying members, wherein the signal processing unit is configured to selectively monitor the signals provided by the first and second set of sensors;

wherein the first and second signal carrying members are generally parallel with each other;

the industrial roll in combination with a first mating structure positioned relative to the industrial roll to form a first nip therewith and a second mating structure positioned relative to the industrial roll to form a second nip therewith, wherein the sensing system is configured such that no more than one sensor of the first sensor set is positioned in the first nip and the second nip simultaneously and no more than one sensor of the second sensor set is positioned in the first nip and the second nip simultaneously.

9. The industrial roll of claim 8, wherein the sensors of the first set of sensors and the sensors of the second set of sensors are axially spaced apart from each other.

10. The industrial roll of claim 8, wherein the first and second helix angles are substantially equal.

11. The industrial roll in combination with the first and second mating structures as defined in claim 8, wherein the first and second nips define an angle therebetween relative to the axis of rotation of the roll, and wherein the first and second helix angles are less than or equal to the angle defined by the first and second nips.

12. The industrial roll of claim 8, wherein the signal processing unit is configured to alternately monitor the signals from the first set of sensors and the signals from the second set of sensors.

13. The industrial roll of claim 8, wherein the operating parameter is pressure.

14. The industrial roll of claim 8, wherein the first and second helix angles are each less than 180 degrees.

15. An industrial roll, comprising:

a substantially cylindrical core having an outer surface;

a polymeric cover circumferentially overlying the core outer surface; and a sensing system comprising:

a first signal carrying member serially connecting a first set of sensors at least partially embedded in the polymeric cover and arranged in a first helical configuration defined by a first helix angle around the roll, wherein the sensors are configured to sense an operating parameter experienced by the roll and provide signals related to the operating parameter, and wherein the first helix angle is defined by an angle between a circumferential position of a first endmost sensor in the first set of sensors and a circumferential position of a second endmost sensor in the first set of sensors relative to the axis of rotation of the roll;

a second signal carrying member spaced apart from the first signal carrying member, the second signal carrying member serially connecting a second set of sensors at least partially embedded in the polymeric cover and arranged in a second helical configuration defined by a second helix angle around the roll, wherein the sensors are configured to sense an operating parameter experienced by the roll and provide signals related to the operating parameter, and wherein the second helix angle is defined by an angle between a circumferential position of a first endmost sensor in the second set of sensors and a circumferential position of a second endmost sensor in the second set of sensors relative to the axis of rotation of the roll; and a signal processing unit operatively associated with the first and second signal carrying members, wherein the signal processing unit is configured to selectively monitor the signals provided by the first and second set of sensors;

wherein the first helix angle and the second helix angle are substantially equal;

the industrial roll in combination with a first mating structure positioned relative to the industrial roll to form a first nip therewith and a second mating structure positioned relative to the industrial roll to form a second nip therewith, wherein the sensing system is configured such that no more than one sensor of the first sensor set is positioned in the first nip and the second nip simultaneously and no more than one sensor of the second sensor set is positioned in the first nip and the second nip simultaneously.

16. The industrial roll of claim 15, wherein the sensors of the first set of sensors and the sensors of the second set of sensors are axially spaced apart from each other.

17. The industrial roll in combination with the first and second mating structures as defined in claim 15, wherein the first and second nips define an angle therebetween relative to the axis of rotation of the roll, and wherein the first and second helix angles are less than or equal to the angle defined by the first and second nips.

18. The industrial roll of claim 15, wherein the signal processing unit is configured to alternately monitor the signals from the first set of sensors and the signals from the second set of sensors.

19. The industrial roll of claim 15, wherein the operating parameter is pressure.

20. The industrial roll of claim 15, wherein the first and second helix angles are each less than 180 degrees.

21. An industrial roll, comprising:

a substantially cylindrical core having an outer surface;

a polymeric cover circumferentially overlying the core outer surface; and a sensing system comprising:

a first signal carrying member serially connecting a first set of sensors at least partially embedded in the polymeric cover and arranged in a first helical configuration defined by a first helix angle around the roll, wherein the sensors are configured to sense an operating parameter experienced by the roll and provide signals related to the operating parameter, and wherein the first helix angle is defined by an angle between a circumferential position of a first endmost sensor in the first set of sensors and a circumferential position of a second endmost sensor in the first set of sensors relative to the axis of rotation of the roll;

a second signal carrying member spaced apart from the first signal carrying member, the second signal carrying member serially connecting a second set of sensors at least partially embedded in the polymeric cover and arranged in a second helical configuration defined by a second helix angle around the roll, wherein the sensors are configured to sense an operating parameter experienced by the roll and provide signals related to the operating parameter, and wherein the second helix angle is defined by an angle between a circumferential position of a first endmost sensor in the second set of sensors and a circumferential position of a second endmost sensor in the second set of sensors relative to the axis of rotation of the roll; and a signal processing unit operatively associated with the first and second signal carrying members, wherein the signal processing unit is configured to selectively monitor the signals provided by the first and second set of sensors;

wherein the first endmost sensor of the first signal carrying member and the first endmost sensor of the second signal carrying member are circumferentially spaced from each other;

the industrial roll in combination with a first mating structure positioned relative to the industrial roll to form a first nip therewith, wherein the sensing system is configured such that no more than one sensor of the first sensor set is positioned in the first nip simultaneously and no more than one sensor of the second sensor set is positioned in the first nip simultaneously.

22. An industrial roll, comprising:

a substantially cylindrical core having an outer surface;

a polymeric cover circumferentially overlying the core outer surface; and a sensing system comprising:

a first signal carrying member serially connecting a first set of sensors at least partially embedded in the polymeric cover and arranged in a first helical configuration defined by a first helix angle around the roll, wherein the sensors are configured to sense an operating parameter experienced by the roll and provide signals related to the operating parameter, and wherein the first helix angle is defined by an angle between a circumferential position of a first endmost sensor in the first set of sensors and a circumferential position of a second endmost sensor in the first set of sensors relative to the axis of rotation of the roll;

a second signal carrying member spaced apart from the first signal carrying member, the second signal carrying member serially connecting a second set of sensors at least partially embedded in the polymeric cover and arranged in a second helical configuration defined by a second helix angle around the roll, wherein the sensors are configured to sense an operating parameter experienced by the roll and provide signals related to the operating parameter, and wherein the second helix angle is defined by an angle between a circumferential position of a first endmost sensor in the second set of sensors and a circumferential position of a second endmost sensor in the second set of sensors relative to the axis of rotation of the roll; and a signal processing unit operatively associated with the first and second signal carrying members, wherein the signal processing unit is configured to selectively monitor the signals provided by the first and second set of sensors;

wherein the first and second helix angles do not overlap;

the industrial roll in combination with a first mating structure positioned relative to the industrial roll to form a first nip therewith, wherein the sensing system is configured such that no more than one sensor of the first sensor set is positioned in the first nip simultaneously and no more than one sensor of the second sensor set is positioned in the first nip simultaneously.

23. An industrial roll, comprising:

a substantially cylindrical core having an outer surface;

a polymeric cover circumferentially overlying the core outer surface; and a sensing system comprising:

a first signal carrying member serially connecting a first set of sensors at least partially embedded in the polymeric cover and arranged in a first helical configuration defined by a first helix angle around the roll, wherein the sensors are configured to sense an operating parameter experienced by the roll and provide signals related to the operating parameter, and wherein the first helix angle is defined by an angle between a circumferential position of a first endmost sensor in the first set of sensors and a circumferential position of a second endmost sensor in the first set of sensors relative to the axis of rotation of the roll;

a second signal carrying member spaced apart from the first signal carrying member, the second signal carrying member serially connecting a second set of sensors at least partially embedded in the polymeric cover and arranged in a second helical configuration defined by a second helix angle around the roll, wherein the sensors are configured to sense an operating parameter experienced by the roll and provide signals related to the operating parameter, and wherein the second helix angle is defined by an angle between a circumferential position of a first endmost sensor in the second set of sensors and a circumferential position of a second endmost sensor in the second set of sensors relative to the axis of rotation of the roll; and a signal processing unit operatively associated with the first and second signal carrying members, wherein the signal processing unit is configured to selectively monitor the signals provided by the first and second set of sensors;

wherein each of the sensors of the first plurality are axially unique from each of the sensors of the second plurality;

the industrial roll in combination with a first mating structure positioned relative to the industrial roll to form a first nip therewith, wherein the sensing system is configured such that no more than one sensor of the first sensor set is positioned in the first nip simultaneously and no more than one sensor of the second sensor set is positioned in the first nip simultaneously.

* * * * *